US006925996B1

(12) United States Patent
Todd

(10) Patent No.: US 6,925,996 B1
(45) Date of Patent: Aug. 9, 2005

(54) BOWSTRING RELEASE DEVICE WITH STRING LOOP AND BUILT-IN NOCK RECEIVER

(76) Inventor: Gary J. Todd, 33551 Giftos, Clinton Township, MI (US) 48032

( * ) Notice: Subject to any disclaimer, the term of this patent is extended or adjusted under 35 U.S.C. 154(b) by 0 days.

(21) Appl. No.: 10/858,359

(22) Filed: Jun. 1, 2004

(51) Int. Cl.[7] ..... F41B 5/18
(52) U.S. Cl. ..... 124/35.2; 124/91
(58) Field of Search ..... 124/35.2, 90, 91

(56) References Cited

U.S. PATENT DOCUMENTS

| | | | | |
|---|---|---|---|---|
| 4,309,975 | A | 1/1982 | Altier | |
| 4,567,875 | A | 2/1986 | Fletcher | |
| 4,724,821 | A | 2/1988 | Besaw | |
| 4,791,908 | A | 12/1988 | Pellis | |
| 4,877,009 | A | 10/1989 | Becker | |
| 4,887,584 | A * | 12/1989 | Carella | 124/90 |
| 4,930,485 | A * | 6/1990 | Kopper | 124/91 |
| 4,981,128 | A * | 1/1991 | Garvison | 124/35.2 |
| 5,025,772 | A | 6/1991 | Stevenson | |
| 5,052,365 | A * | 10/1991 | Carella | 124/90 |
| 5,224,463 | A | 7/1993 | Townsend | |
| 5,499,620 | A * | 3/1996 | Summers | 124/91 |
| 5,715,805 | A * | 2/1998 | Summers et al. | 124/90 |
| 5,904,135 | A * | 5/1999 | Summers et al. | 124/91 |
| 6,234,158 | B1 * | 5/2001 | Summers | 124/91 |
| 6,343,600 | B1 * | 2/2002 | Steinman | 124/91 |

* cited by examiner

*Primary Examiner*—John A. Ricci
(74) *Attorney, Agent, or Firm*—Charles W. Chandler

(57) ABSTRACT

A bowstring release aid has a string loop. The release aid is mounted on a bowstring and drawn to an arrow release position by a hand-held string release device. The hand-held release device releases the string loop so that both the bowstring with the release aid propels the arrow.

15 Claims, 2 Drawing Sheets

BOWSTRING RELEASE DEVICE WITH STRING LOOP AND BUILT-IN NOCK RECEIVER

BACKGROUND AND SUMMARY OF THE INVENTION

This invention, which mounts on a bowstring, consists of a string loop that attaches to a U-shaped device into which the nock of an arrow is placed. The device is released with the drawn bowstring by a hand-held trigger-operated release (commonly known as a release aid) connected to the string loop to propel the nock and its arrow toward an intended target. The invention, described in more detail in the paragraphs and pages that follow, provides significant improvements over the current typical archery bowstring release system.

Archers try to achieve better accuracy with their equipment so that an arrow will accurately and consistently strike a target. One of the conditions that affects arrow accuracy is the manner and method in which the bowstring connects to the release aid and is released. Typically, a bowstring is drawn and released by a hand-held trigger-operated release aid, that is, the user squeezes a trigger to open a pair of jaws that holds the bowstring. However, there is a tendency for release aids both to wear the bowstring, and to provide a twisting or torquing of the bowstring as the bowstring is drawn back before the arrow is released.

To overcome this twisting and torquing problem, and as a result improve arrow accuracy, several patents in the prior art disclose variations of release aids and other releases devices, including a string loop wrapped directly around the bowstring in such a manner that when the trigger of a release aid is actuated, the string loop releases the bowstring. Examples of such prior art include U.S. Pat. No. 5,904,135 issued May 18, 1999 to Gregory E. Summers et al. for "Bowstring Nock/Release Loop Assembly; U.S. Pat. No. 5,224,463 issued Jul. 6, 1993 to Robert R. Townsend for "Bowstring Release Assembly"; U.S. Pat. No. 5,025,772 issued Jun. 25, 1991 to Mark W. Stevenson for "Bowstring Release Device"; U.S. Pat. No. 4,877,009 issued Oct. 31, 1989 to Richard R. Becker for "Bowstring Draw and Release Device"; U.S. Pat. No. 4,791,908 issued Dec. 20, 1988 to Mario A. Pellis for "Bowstring Release Mechanism"; U.S. Pat. No. 4,724,821 issued Feb. 16, 1988 to Jean B. Besaw for "Bow String Release Device"; U.S. Pat. No. 4,567,875 issued Feb. 4, 1986 to James D. Fletcher for "Bowstring Release Device"; and U.S. Pat. No. 4,309,975 issued Jan. 12, 1982 to Anthony L. Altier for "Archery Bowstring Release".

Applicant has invented a bowstring release combination in which a bowstring release device with an attached string loop connects to the bowstring and moves with the bowstring as it is drawn and released. The overall shape of the body of the bowstring release device is U-shaped. The bowstring passes through openings in the two legs of the U-shaped body.

A string loop protrudes from the bowstring release device body along an extension of the longitudinal axis of the arrow. Any common form of hand-held bowstring release aid or mechanism can then be engaged with the string loop. When the user draws the bowstring rearwardly and releases the string loop, both the bowstring release device and the attached string loop travel with the bowstring. Virtually no torque is applied to the bowstring by the string loop.

The unique design of the release device with its attached string loop enables an archer to rotate any hand-held release aid (engaged with the attached string loop) up to 180° without torquing or twisting the bowstring, thereby providing more accurate arrow flight when an archer does twist his hand-held release aid (a common occurrence when drawing a bowstring). The string loop prevents and absorbs the torquing or twisting of the release aid. This device also eliminates wear on the bowstring, since any hand-held release aid is engaged directly with the attached loop string rather than the bowstring. In addition, since any hand-held release aid attaches to the string loop rather than the bowstring, this device improves accuracy by eliminating any unbalanced pressure on the arrow nock, which is a common occurrence when using nock points with a loop string attached directly to the bowstring. Also, the attached string loop can be easily replaced as the need arises. Further, this device provides a secure and tailored fit for common size arrow nocks, preventing the arrow from falling off the bowstring, which is another common occurrence when drawing a bowstring. The device also facilitates easy alignment of the target with the arrow for improved accuracy, because of how and where it is mounted on the bowstring and because of how and where it is positioned in relation to the arrow.

Still further objects and advantages of the invention will become readily apparent to those skilled in the art to which the invention pertains upon its use and upon reference to the following description.

DESCRIPTION OF THE DRAWINGS

The description refers to the accompanying drawings in which like reference characters refer to like parts throughout the several views, and in which.

DESCRIPTION OF THE PREFERRED EMBODIMENT

Figure 1:
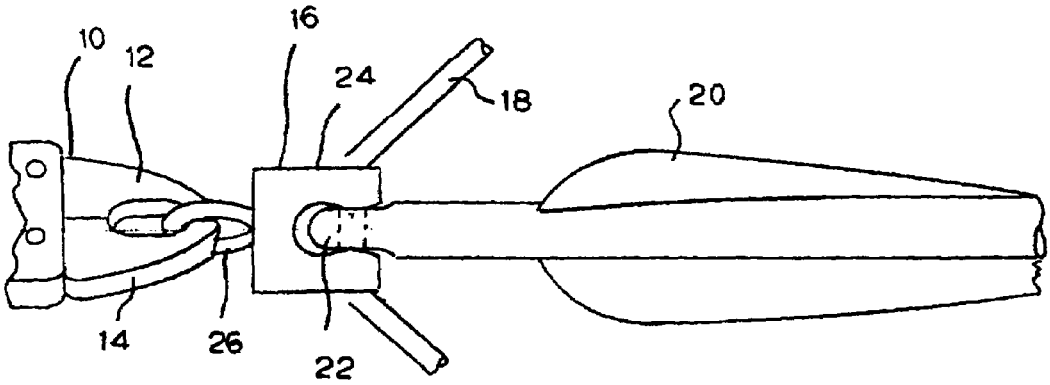
FIG. 1 illustrates the jaws of a hand-held archery release aid connected to a device provided with a built-in arrow nock receiver and attached string loop, illustrating the invention as it appears when mounted on drawn bowstring while holding an arrow.
Figure 2:
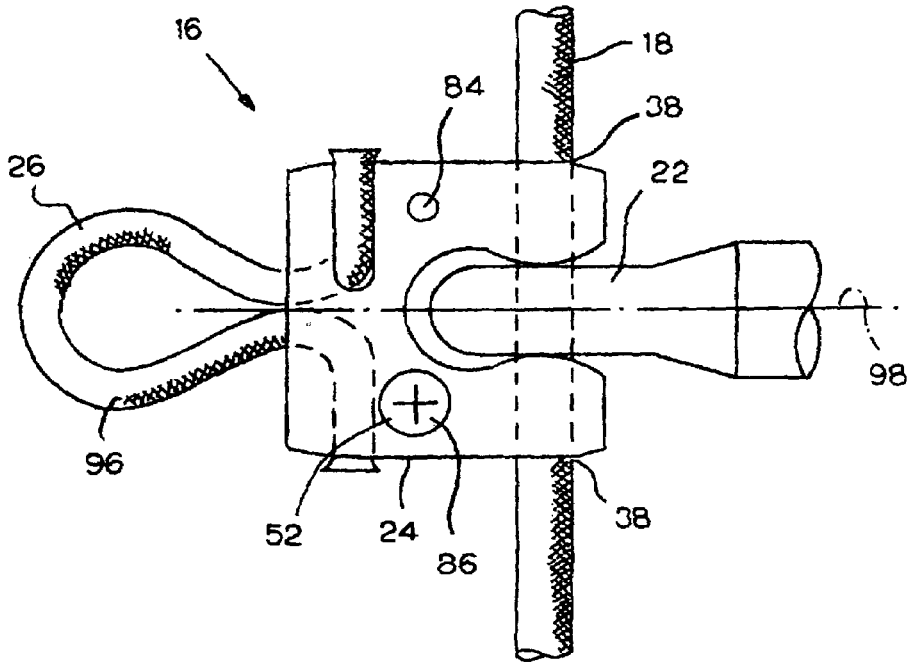
FIG. 2 is another view of the device holding an arrow nock with the bowstring in the undrawn position.
Figure 3:
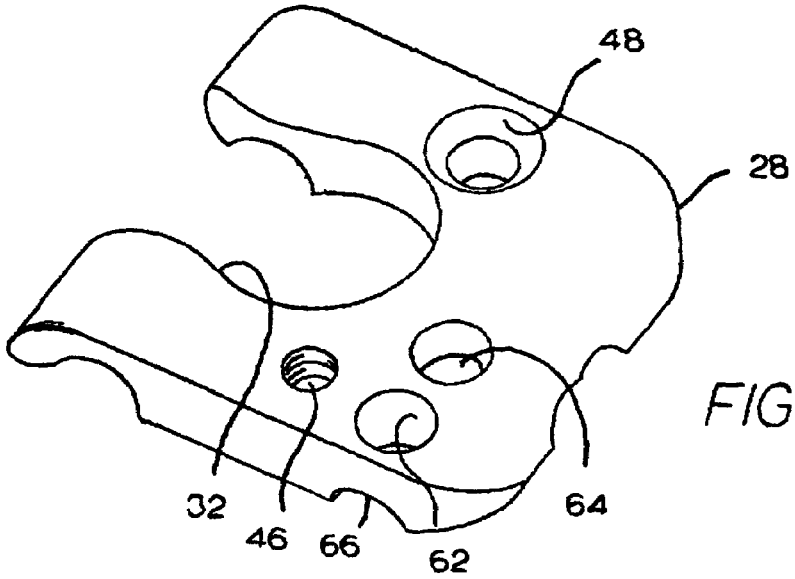
FIG. 3 is a perspective view of the top side of one of the two similarly shaped plates that form the body of the device.

Referring to the drawings, FIG. 1 illustrates the head of a hand-held release aid 10 having a pair of jaws 12 and 14 connected to a string loop release device 16 mounted on a bowstring 18 of a conventional bow. Hand-held release aid 10 may be any of a number of loop compatible (that is able to grab and hold the string loop without the string loop slipping through the jaws of the release aid as the bowstring is drawn back) release aids. A conventional arrow 20 has a nock 22 engaging bowstring 18 as illustrated in FIG. 1. FIG. 2 illustrates the release device 16, with its attached string loop 26 and built-in nock receiver (the open area of the device that receives and holds arrow nock 22 on the bowstring), on the bowstring in a non-drawn position.

The string loop release device includes a body 24 and a string loop 26. Body 24 comprises a pair of similarly shaped U-shaped plates 28 and 30. Plate 28 is illustrated in FIGS.

3 and 4 and has an opening 32 along a front edge, and a pair of aligned semi-cylindrical grooves 34 and 36.

Plate 28 has a pair of threaded fastener-receiving openings 46 and 48. Plate 28 also has a central groove 54 formed along an axis 56 which is at right angles to axis 40 of grooves 34 and 36. Plate 28 has an elongated groove 58 parallel to axis 40 and which terminates with opening 60. Plate 28 has another pair of string loop openings 62 and 64. Opening 62 is connected to side opening 66.

Figure 5:
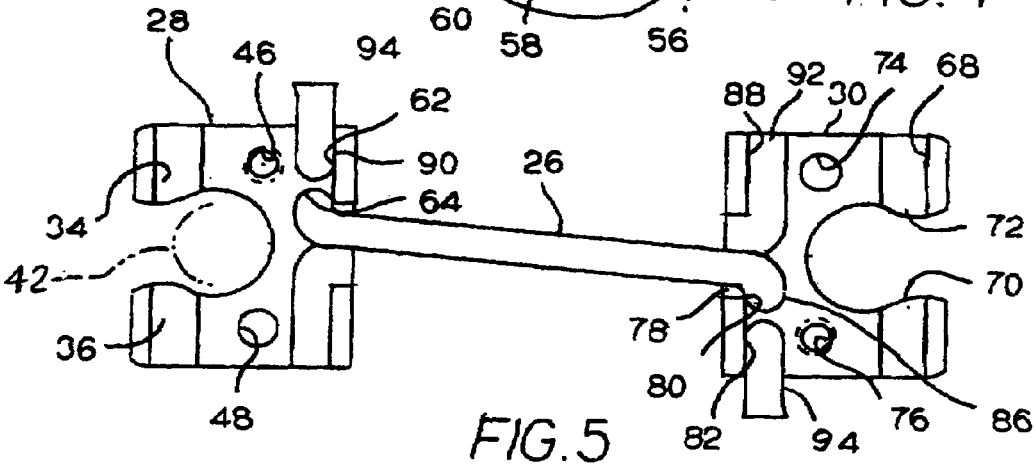
FIG. 5 illustrates the manner in which the attached string loop has its ends connected to the two plates that form the body of the release device.

Referring to FIG. 5, plate 30 has a pair of aligned grooves 68 and 70 for receiving bowstring 18. When the two plates are connected face-to-face, grooves 68 and 70 combine with grooves 34 and 36 to form two spaced aligned openings 38 (see FIG. 2) along axis 40 to receive the bowstring.

Figure 4:
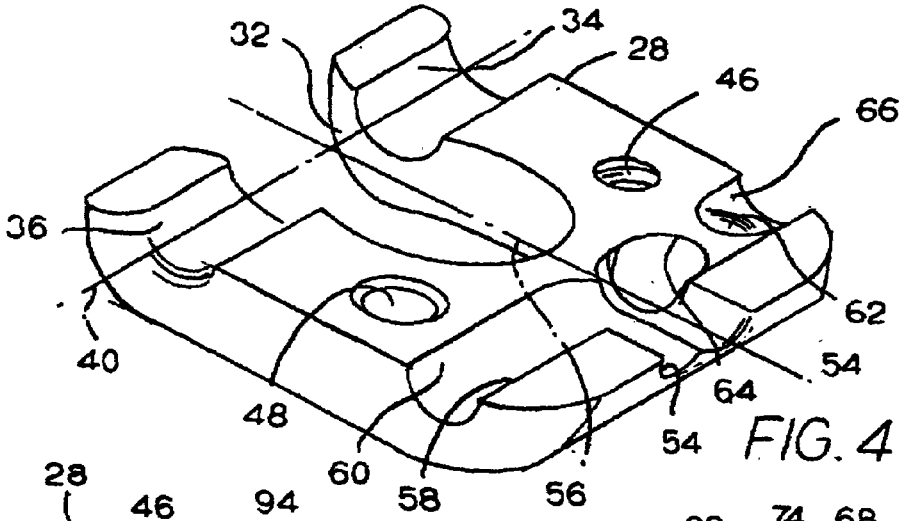
FIG. 4 is a perspective view of the opposite or bottom side of the plate of FIG. 3.

Plate 30 has a pair of fastener-receiving openings 74 and 76. Plate 30 has a central groove 78 disposed in a face-to-face relationship with groove 54 (see FIG. 4) of plate 28. Plate 30 has a pair of string-receiving grooves 80 and 82 for receiving string loop 26. The extreme end of the string loop at 84 is enlarged to a diameter greater than the diameter of side opening 60 when groove 58 is aligned with opening groove 86, by applying heat to the string loop. Plate 30 also has a groove 88 which mates with groove 90 of plate 28 to form a side opening 92.

When the two plates are engaged in a face-to-face relationship and fastened together, string loop 26 has a diameter chosen to receive jaws 12 and 14 of hand-held release aid 10, and the center opening formed by grooves 54 and 78 is aligned along the longitudinal axis 98 of the arrow.

For illustrative purposes the installation process is as follows: the user cuts the loop string to a desired length, for example a four-inch piece will easily form an enlarged loop opening. The loop string is preferably formed of a plastic-based material but can be made of any of the various materials used for this purpose. The two ends of the string are exposed to a flame so that they melt, and temporarily liquefy. While liquidified, the user carefully wipes each end with a wet cloth to form a small point to make threading the string easier and unraveling less likely. The heat may be supplied for example by the flame of a cigarette lighter.

One end of the loop string is threaded through the two string loop openings 62 and 64 in plate 28, as shown in FIG. 5. The other end of the loop string is threaded through openings 80 and 82 in plate 30. The two plates are then loosely joined together while adjusting the loop string so that the middle part of the loop protrudes the desired length from the center opening formed by grooves 54 and 78 at the rear of the body. The ends of the loop string then protrude through the side openings. Any slack in the loop string is eliminated so that the string is adequately locked in place. The locking of the loop string is enhanced further by cutting the ends of the loop string and melting the ends to form a small ball having a diameter larger than the diameter of side opening.

The bowstring release device is then slipped over the bowstring and two screws 84 and 86 lock the two halves together on the bowstring. When the two plates are fastened together, they clamp the bowstring between them. The preferred embodiment of the invention, mounted on the bowstring, is as illustrated in FIG. 2.

To shoot arrow 20, the nock of the arrow 22 is inserted into opening 42 and around bowstring 18. The nock receiver opening 42 narrows in its width where the nock fits on the bowstring to prevent the nock and arrow from disengaging and falling off the bowstring when drawing back on the bow. The sizes and shape of the opening are designed to accommodate common size arrow nocks and to provide a smooth and free release of an arrow when it is propelled from the bowstring.

The archer then uses a hand-held trigger-operated release aid by inserting the jaws into the opening of the loop 26, and then draws the bowstring to flex the bow (not shown) to the desired tautness. The archer then opens jaws 12 and 14 to release the bowstring and to project or shoot the arrow. It is to be noted that body 24 and string loop 26 of the bowstring release device travel with the bowstring when the arrow is projected.

Such an arrangement provides virtually no torque on the bowstring, as the bowstring is drawn and released, because of the flexibility provided by the string loop and the unique way the string loop inserts into and attaches to the body of the bowstring release device. That is, even though the hand-held release aid may be twisted or torqued with respect to the axis 98 of the arrow when drawing the bowstring, the string loop absorbs the effects of any twisting or torquing action, which ensures that the hand-held release aid does not provide any torque on the bowstring so as to influence the travel of the arrow.

Having described the invention, what is claimed is:

1. An archery bowstring release system, comprising:

a bowstring of an archery bow;

a bowstring release device body mounted on the bowstring, comprising a pair of similarly u-shaped clamping halves disposed in a face-to-face relationship to form a body having a bight with a single central opening, a pair of spaced legs having aligned openings for clamping a bowstring therebetween, and an arrow nock-receiving opening between said legs for receiving the clamped bowstring in said aligned openings;

a release string forming a loop having a pair of ends received in a side-by-side relationship in the single central opening of the bowstring release device; and a hand-held release aid connected to the string loop, whereby the bowstring release device may be drawn with the bowstring toward an arrow release position by the release aid, and the bowstring and the bowstring release device may be released by separating the release aid from the string loop.

2. An archery bowstring release system as defined in claim 1, in which the body of the bowstring release device is so formed and designed as to hold and retain the ends of the string loop.

3. An archery bowstring release system as defined in claim 1, in which the body of the bowstring release device has a pair of side openings for passing the string loop ends therethrough in opposite directions.

4. An archery bowstring release device as defined in claim 3, in which the central opening holding the string loop together forms a centered pivot point for the string loop.

5. An archery bowstring release device as defined in claim 4, in which the string loop is located directly behind the narrow nock as the arrow sits on the bowstring while being drawn.

6. A bowstring release device as defined in claim 3, in which the release device body has a pair of side opening for supporting the string loop ends along an axis at right angles to the direction the string loop ends are received into the central opening in the body of the release device.

7. A bowstring release device as defined in claim 4, in which the central opening for the string loop is aligned with the longitudinal axis of an arrow having a nock engaged with a bowstring connected to the release device.

8. A bowstring release device as defined in claim 3, in which the bowstring is connected to the bowstring release device such that the ends of the string loop are disposed along an axis parallel to the bowstring.

9. An archery bowstring release system as defined in claim 1, including fastener means for connecting said two u-shaped halves together in a clamping position on the bowstring.

10. A bowstring release device as defined in claim 9, in which the two u-shaped halves form a central opening and a pair of side openings for the string loop, and the ends of the string loop are disposed in the two halves and threaded through the two side openings and the center length of the string forms a loop outside the central opening to receive the jaws of a release aid.

11. A bowstring release device as defined in claim 10, in which a series of right-angled holes provided in the body of the device lock the string loop to said body and through which the extreme ends of the string loop are threaded.

12. An archery bow system as defined in claim 11, in which the string loop has a pair of ends, and the release aid has a central opening for receiving the string loop, and a pair of side openings for passing the string loop ends therethrough.

13. A bowstring release device as defined in claim 9, in which the body has a nock-receiving opening between the legs for receiving the arrow nock on the bowstring.

14. A bowstring release device as defined in claim 13 in which the nock-receiving opening has a reduced width such that common size arrow nocks are held by and touch the body of the device only at the narrowest width of the opening where the device receives the arrow nock on the bowstring.

15. A bowstring release device as defined in claim 14, in which the arrow-receiving opening holds the arrow nock in place, is held straight and prevented from flexing.

* * * * *